US010276958B1

(12) United States Patent
Mason et al.

(10) Patent No.: US 10,276,958 B1
(45) Date of Patent: Apr. 30, 2019

(54) ELECTRICAL CONTACT GRID ARRAY

(71) Applicant: TE CONNECTIVITY CORPORATION, Berwyn, PA (US)

(72) Inventors: Jeffery Walter Mason, North Attleboro, MA (US); Wayne Stewart Alden, III, Whitman, MA (US); Peter David Wapenski, Foster, RI (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 15/592,598

(22) Filed: May 11, 2017

(51) Int. Cl.

| | |
|---|---|
| ***H01R 12/00*** | (2006.01) |
| ***H01R 12/71*** | (2011.01) |
| ***H01R 13/6471*** | (2011.01) |
| ***H01R 13/6585*** | (2011.01) |

(52) U.S. Cl.
CPC ..... *H01R 12/714* (2013.01); *H01R 13/6471* (2013.01); *H01R 13/6585* (2013.01)

(58) Field of Classification Search
CPC H01R 2103/00; H01R 24/50; H01R 23/7073; H01R 23/722; H01R 23/725; H01R 9/096
USPC ..... 439/63, 66, 70, 71, 74
See application file for complete search history.

(56) References Cited

U.S. PATENT DOCUMENTS

| | | | | |
|---|---|---|---|---|
| 6,231,352 | B1 * | 5/2001 | Gonzales | H01R 12/52 439/66 |
| 6,388,208 | B1 * | 5/2002 | Kiani | H05K 1/0222 174/260 |
| 7,503,768 | B2 * | 3/2009 | Tutt | H01R 13/2414 439/66 |
| 7,549,871 | B2 | 6/2009 | Pennypacker et al. | |
| 8,968,007 | B2 * | 3/2015 | Kuwahara | H01R 12/714 439/66 |
| 9,059,545 | B2 * | 6/2015 | Mason | H01R 12/714 |

* cited by examiner

*Primary Examiner* — Hien Vu

(57) ABSTRACT

An electrical contact grid array includes a board having a top side and an opposite bottom side, a plurality of signal conductors mounted to the board, and a plurality of ground shield structures mounted to the board. Each of the signal conductors includes an upper signal contact extending beyond the top side of the board for electrically connecting with a corresponding mating contact of a mating circuit board. Each of the ground shield structures includes at least one ground contact disposed above the top side of the board that defines an upper annular shield. The upper annular shield circumferentially surrounds at least one of the upper signal contacts.

20 Claims, 4 Drawing Sheets

ELECTRICAL CONTACT GRID ARRAY

BACKGROUND

The subject matter herein relates generally to socket connectors configured to electrically connect to printed circuit boards, and more specifically, to an electrical contact grid array for use in socket connectors.

The ongoing trend toward smaller and faster electrical components and higher density electrical circuits has led to the development socket connectors for electrically connecting printed circuit boards to integrated circuit packages. Known socket connectors have an open field of contacts in an array. Some of the contacts are designated as signal contacts used to transmit data or convey power, while other contacts in the array provide ground shielding for the signal contacts. In some known socket connectors, each signal contact or pair of signal contacts is surrounded by a group of ground contacts. For example, the contact array may include many parallel rows of contacts. A single signal contact may be shielded by ground contacts on either side of the signal contact in the same row, as well as by ground contacts in adjacent rows. The ground contacts may be balls, beams, or pins that are similar to, if not identical to the signal contacts. For example, although each signal contact may be surrounded by several ground contacts, the ground contacts are spaced apart from one another and may be relatively narrow, such that gaps between the ground contacts in the open contact array may limit the amount of shielding provided by the ground contacts. As the signal transmission speeds increase, adequate shielding of the signal contacts requires additional ground contacts that are located closer together, which may substantially increase the cost of the socket connectors.

A need remains for a low-cost electrical contact grid array that provides enhanced electrical shielding performance.

BRIEF DESCRIPTION

In an embodiment, an electrical contact grid array is provided that includes a board having a top side and an opposite bottom side, a plurality of signal conductors mounted to the board, and a plurality of ground shield structures mounted to the board. Each of the signal conductors includes an upper signal contact extending beyond the top side of the board for electrically connecting with a corresponding mating contact of a mating circuit board. Each of the ground shield structures includes at least one ground contact disposed above the top side of the board that defines an upper annular shield. The upper annular shield circumferentially surrounds at least one of the upper signal contacts.

In another embodiment, an electrical contact grid array is provided that includes a board having a top side and an opposite bottom side, a plurality of signal conductors mounted to the board, and a plurality of ground shield structures mounted to the board. The board defines holes extending through the board from the top side to the bottom side. Each of the signal conductors includes an upper signal contact extending beyond the top side of the board, a lower signal contact extending beyond the bottom side of the board, and an intermediate portion disposed within a corresponding one of the holes in the board. Each of the ground shield structures includes an upper annular shield defined by at least one upper ground contact, a lower annular shield defined by at least one lower ground contact, and mounting posts extending through the holes in the board. The mounting posts connect the upper ground contacts to the lower ground contacts. The upper annular shield of each of the ground shield structures circumferentially surrounds at least one of the upper signal contacts. The lower annular shield of each of the ground shield structures circumferentially surrounds at least one of the lower signal contacts.

In another embodiment, an electrical contact grid array is provided that includes a board having a top side and an opposite bottom side, a plurality of signal conductors mounted to the board, and a plurality of ground shield structures mounted to the board. Each of the signal conductors includes an upper signal contact extending beyond the top side of the board for electrically connecting with a corresponding mating contact of a mating circuit board. Each of the ground shield structures includes at least one ground contact disposed above the top side of the board and defining an upper annular shield. The upper annular shield circumferentially surrounds at least one of the upper signal contacts. The ground shield structures are made of one or more of a conductive polymer material or an electrically lossy material.

DETAILED DESCRIPTION OF SPECIFIC EMBODIMENTS

One or more embodiments of the inventive subject matter described herein provide an electrical contact grid array. The electrical contact grid array includes multiple shielded conductor sets mounted to an electrically insulated board. Each shielded conductor set includes at least one signal contact and a ground shield structure that circumferentially surrounds the at least one signal contact to provide electrical shielding for the at least one signal contact. The circumferential or annular footprint of the ground shield structure may provide enhanced electrical shielding for the one or more signal contacts surrounded by the ground shield structure, relative to known contact arrays that use multiple narrow ground contacts in the same and adjacent rows as one or more signal contacts to provide electrical shielding. For example, the ground contacts in known contact arrays may have the shape of pins, deflectable beams, compressible beams or barrels, or the like, and may be spaced apart from one another by gaps. Due to the narrow shapes of the ground contacts and the gaps therebetween, the ground contacts of known contact arrays only circumferentially surround a portion of the one or more signal contacts, which limits the electrical shielding performance. The ground shield structures of the electrical contact grid array described herein provides enhanced electrical shielding because the ground shield structures surround a greater portion of the one or more signal contacts than the ground contacts of the known contact arrays, such as surrounding a full perimeter of the one or more signal contacts or surrounding a majority of the perimeter, such as at least 75% of the perimeter.

Figure 1:
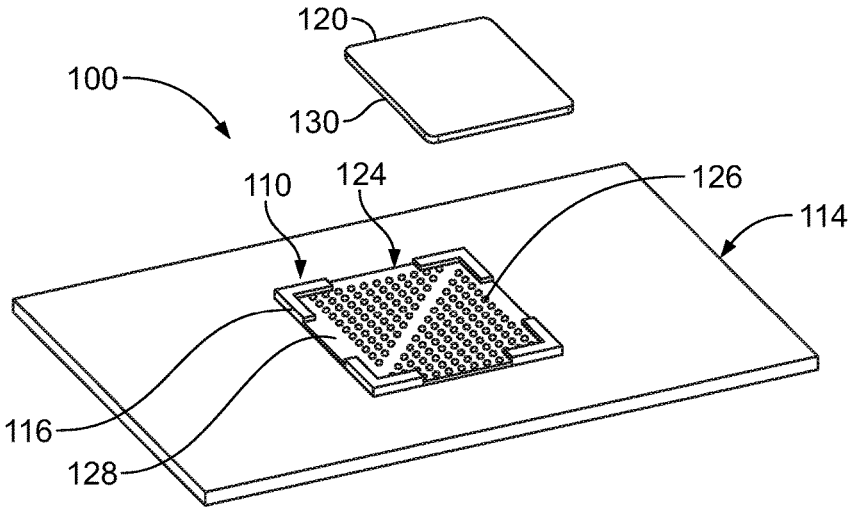
FIG. 1 is a perspective view of an electrical connector assembly according to an embodiment.

FIG. 1 is a perspective view of an electrical connector assembly 100 according to an embodiment. The electrical connector assembly 100 includes a circuit board 114 and an electrical contact grid array 124. The electrical contact grid array 124 includes a plurality of shielded conductor sets 126 arranged on a board 128. The shielded conductor sets 126 are configured to engage and electrically connect to the corresponding electrical elements on the circuit board 114. In an embodiment, the electrical contact grid array 124 represents or defines a portion of a socket connector 110 that is configured to electrically interconnect the circuit board 114 to an electronic package 120. For example, the socket connector 110 is mounted to the circuit board 114. The socket connector 110 includes the electrical contact grid array 124 and a housing 116 that at least partially surrounds the board 128 of the electrical contact grid array 124.

The electronic package 120 is configured to be loaded onto the socket connector 110 such that the electronic package 120 is received within the housing 116. A mating surface 130 of the electronic package 120 engages the shielded conductor sets 126 of the electrical contact grid array 124. When loaded onto the socket connector 110, the electronic package 120 is electrically connected to the circuit board 114 via the electrical contact grid array 124. For example, the shielded conductor sets 126 may be interposed between contact pads (or other electrical elements) on the mating surface 130 of the electronic package 120 and corresponding contact pads (or other electrical elements) on the circuit board 114. The electronic package 120 may be a chip or an integrated circuit such as, but not limited to, a central processing unit (CPU), microprocessor, or an application specific integrated circuit (ASIC). Although the electrical contact grid array 124 is shown in FIG. 1 as a component of the socket connector 110, the embodiments of the electrical contact grid array 124 described herein are not limited to use within a socket connector that interconnects a circuit board and an electronic package. For example, the electrical contact grid array 124 may be used for interconnecting two circuit boards, two electronic packages, or the like. In addition, the electrical contact grid array 124 may be used without the housing 116.

Figure 2:
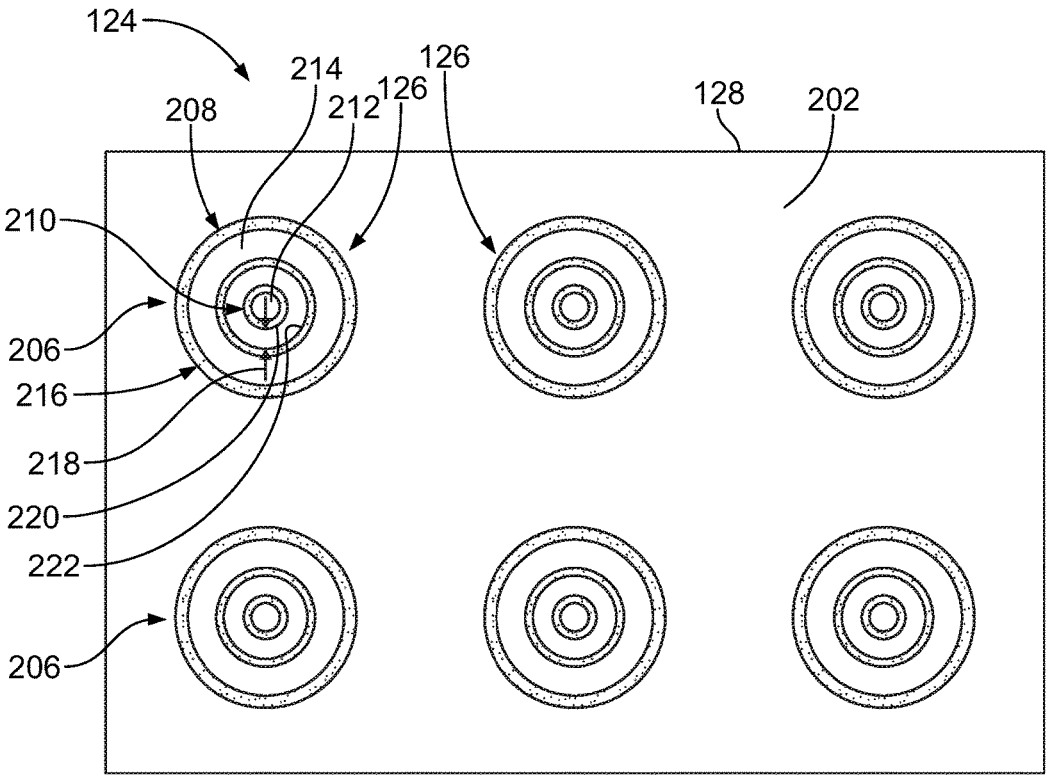
FIG. 2 is a top view of a portion of an electrical contact grid array according to an embodiment.

FIG. 2 is a top view of a portion of the electrical contact grid array 124 according to an embodiment. The board 128 includes a top side 202 and an opposite bottom side 204 (shown in FIG. 3). Only the top side 202 is visible in FIG. 2. As used herein, relative or spatial terms such as "top," "bottom," "upper," "lower," "left," and "right" are only used to distinguish the referenced elements and do not necessarily require particular positions or orientations relative to the surrounding environment of the electrical contact grid array 124.

The illustrated portion of the electrical contact grid array 124 includes six shielded conductor sets 126 mounted to the board 128. The electrical contact grid array 124 may include any number of shielded conductor sets 126, such as 10, 100, 1000, or more shielded conductor sets 126. In an embodiment, the shielded conductor sets 126 are arranged in multiple parallel rows 206 along the top side 202 of the board 128. Each shielded conductor set 126 includes a ground shield structure 208 and at least one signal conductor 210. The ground shield structures 208 and the signal conductors 210 are mounted to the board 128. The ground shield structures 208 are configured to circumferentially surround the signal conductors 210 to provide electrical shielding for the signal conductors 210.

Each signal conductor 210 includes an upper signal contact 212 that extends upward beyond the top side 202 of the board 128. In an embodiment, the upper signal contact 212 has a barrel shape, as shown in more detail in FIG. 4, but the upper signal contact 212 may have a different shape in other embodiments, such as a pin shape, a ball shape, a deflectable beam shape, or the like. Each ground shield structure 208 includes at least one upper ground contact 214 disposed above the top side 202 of the board 128. The upper ground contact(s) 214 of each ground shield structure 208 define an upper annular shield 216 that circumferentially surrounds the one or more upper signal contacts 212 of the respective shielded conductor set 126. The upper ground contact(s) 214 have curved lengths along a plane parallel to the top side 202 of the board 128. In the illustrated embodiment, each ground shield structure 208 includes a unitary, one-piece upper ground contact 214 that forms a closed ring. The unitary upper ground contact 214 has a circular shape in the illustrated embodiment, but may have an elliptical or oval shape in other embodiments. In other embodiments, each ground shield structure 208 may include multiple, discrete upper ground contacts 214 that define respective portions of the upper annular shield 216.

Only one signal conductor 210 is disposed within the interior region formed by the upper annular shield 216 in the illustrated embodiment. The signal conductor 210 is spaced apart from the ground shield structure 208 and does not engage the ground shield structure 208. For example, an annular region 218 of the board 128 is defined along the top side 202 of the board 128 between an outer perimeter 220 of the upper signal contact 212 and an interior edge 222 of the upper ground contact 214. The board 128 is electrically insulative, and the annular region 218 electrically insulates the signal conductor 210 from the ground shield structure 208 that surrounds and shields the signal conductor 210. Since the ground shield structure 208 defines the upper annular shield 216 that surrounds a full perimeter of the upper signal contact 212, the shielding for each signal conductor 210 is accomplished by the single corresponding ground shield structure 208 that surrounds that signal conductor 210. Unlike known open contact field arrays, electrical shielding for each signal conductor 210 is not accomplished via multiple discrete ground contacts, such as four, six, or eight ground contacts, located around the signal conductor 210. As a result, the electrical contact grid array 124 can reduce the number of discrete ground contacts in the array, which may reduce cost. Furthermore, the electrical contact grid array 124 can have more flexibility with regard to the locations and spacing of the signal conductors 210. Since the signal conductors 210 are surrounded by a single ground shield structure 208, the signal conductors 210 do not have to be arranged in rows surrounded by four, six, or eight discrete ground contacts.

Figure 3:
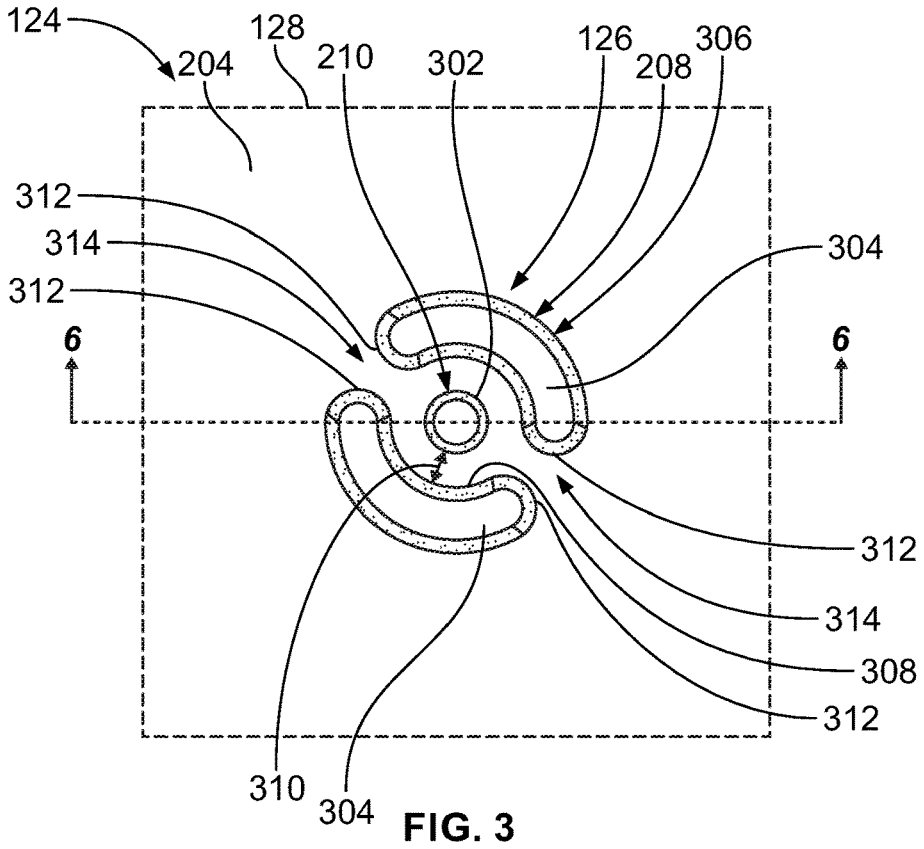
FIG. 3 is a bottom view of a portion of the electrical contact grid array according to an embodiment.

FIG. 3 is a bottom view of a portion of the electrical contact grid array 124 according to an embodiment. The illustrated portion shows one shielded conductor set 126 on the bottom side 204 of the board 128. In one or more embodiments, the shielded conductor sets 126 extend fully through the board 128. The shielded conductor sets 126 include upper portions disposed along and above the top side 202 of the board 128, as shown in FIG. 2, and lower portions disposed along and below the bottom side 204, as shown in FIG. 3. For example, the signal conductor 210 includes a lower signal contact 302 that extends beyond the bottom side 204 of the board 128. The lower signal contact 302 in an embodiment may have the same shape and/or composition, or at least a similar shape and/or composition, as the upper signal contact 212 shown in FIG. 2. The signal conductors 210 are configured to convey electrical current between the upper signal contact 212 and the lower signal contact 302. For example, the signal conductors 210 may be configured to convey electrical current between the circuit board 114 and the electronic package 120 shown in FIG. 1, such that the upper signal contact 212 engages and electrically connects to the electronic package 120 and the lower signal contact 302 engages and electrically connects to the circuit board 114, or vice-versa.

The ground shield structure 208 of the illustrated shielded conductor set 126 includes at least one lower ground contact 304 (for example, two lower ground contacts 304 as shown in FIG. 3) disposed below the bottom side 204 of the board 128. The lower ground contacts 304 define a lower annular shield 306 that circumferentially surrounds the lower signal contact 302 of the signal conductor 210. It is recognized that the ground shield structure 208 may surround multiple signal conductors 210 in an alternative embodiment, such that one lower annular shield 306 would completely circumferentially surround multiple lower signal contacts 302.

In the illustrated embodiment of FIG. 3, the lower annular shield 306 is defined by two lower ground contacts 304. Each of the lower ground contacts 304 have a curved length along a plane parallel to the bottom side 204 of the board 128. The inner edges 308 of the lower ground contacts 304 have concave curves relative to the lower signal contact 302, such that the ground contacts 304 curve around the lower signal contact 302. Optionally, an annular region 310 of board 128 between the lower signal contact 302 and the inner edges 308 of the ground contacts 304 has a relatively uniform width along the lengths of the curved ground contacts 304. The ends 312 of the ground contacts 304 are spaced apart from each other by contact gaps 314. The contact gaps 314 may be present due to manufacturing considerations when using at least two lower ground contacts 304. For example, as described herein, the ground shield structures 208 may be molded in-situ on the board 128, and the contact gaps 314 may be required for the molding process, such as to provide space for a mold. Due to the presence of the contact gaps 314, the lower annular shield 306 of the ground shield structure 208 does not provide full 360 degree shielding of the lower signal contact 302. However, due to the elongated ground contacts 304, the lower annular shield 306 circumferentially surrounds a majority of the lower signal contact 302. For example, the lower annular shield 306 provides shielding along at least about 60%, about 70%, about 80%, or about 90% (e.g., at least about 216 degrees, about 252 degrees, about 288 degrees, or about 324 degrees) of the perimeter of the lower signal contact 302 according to different embodiments. Although two lower ground contacts 304 are shown in FIG. 3, optionally the ground shield structures 208 may include more than two lower ground contacts 304. For example, the lower annular shield 306 may be defined by three or more lower ground contacts 304. In an alternative embodiment, the three or more lower ground contacts 304 may have elongated linear shapes instead of elongated curved shapes.

In the illustrated embodiment shown in FIGS. 2 and 3, the upper annular shield 216 of each ground shield structure 208 is defined by a single, ring-shaped upper ground contact 214, and the lower annular shield 306 is defined by two curved lower ground contacts 304. Alternatively, the ground shield structures 208 may be flipped 180 degrees, such that the lower annular shield 306 is the ring-shaped ground contact and the upper annular shield 216 is defined by two curved ground contacts. In other alternative embodiments, the upper and lower annular shields 216, 306 may have the same or at least similar shapes, such that both annular shields 216, 306 include ring-shaped ground contacts or multiple curved ground contacts.

In an alternative embodiment, the shielded conductor sets 126 do not extend fully through the board 128. For example, the shielded conductor sets 126 are mounted to the board 128 and only extend from the top side 202 or the bottom side 204. In such an embodiment, the annular shield 306 defined by two curved ground contacts 304 shown in FIG. 3 may be viewed as an alternative version of the unitary, one-piece annular shield 216 shown in FIG. 2.

Figure 4:
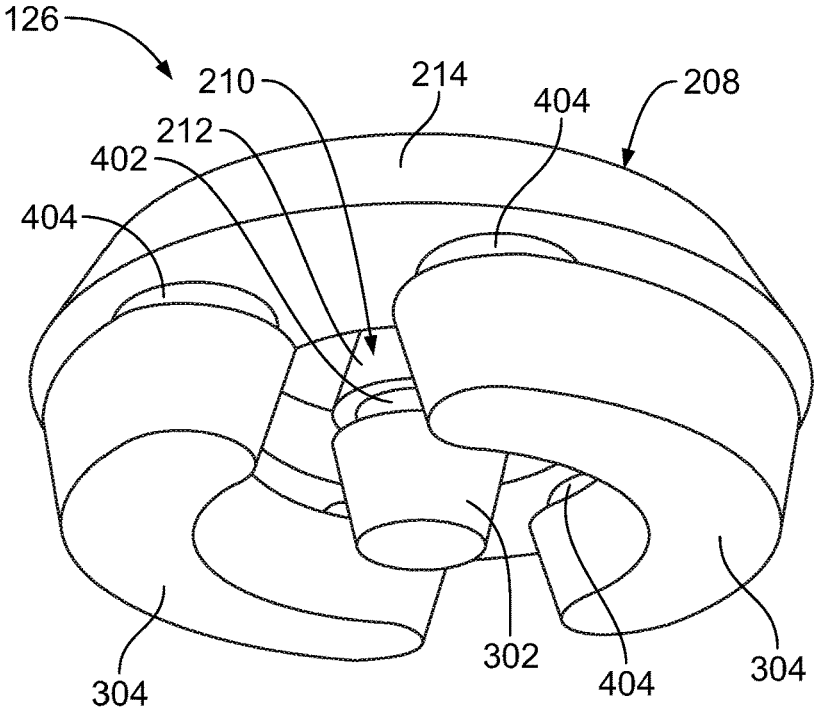
FIG. 4 is a perspective view of a shielded conductor set of the electrical contact grid array according to an embodiment.

FIG. 4 is a bottom perspective view of one of the shielded conductor sets 126 of the electrical contact grid array 124 (such as shown in FIG. 2) according to an embodiment. The board 128 is not shown in FIG. 4. In the illustrated embodiment, the signal conductor 210 has barrel-shaped upper and lower signal contacts 212, 302. The upper and lower signal contacts 212, 302 may be compressible in order to maintain engagement with corresponding electrical elements on the circuit board 114 and electronic package 120 (both shown in FIG. 1) when sandwiched between the circuit board 114 and the electronic package 120. The signal conductor 210 includes an intermediate portion 402 located between the upper and lower signal contacts 212, 302.

The ground shield structure 208 includes mounting posts 404 connecting the upper ground contact 214 to the lower ground contacts 304. The mounting posts 404 may be cylindrical with generally the same diameters. In an embodiment, the intermediate portion 402 of the signal conductor 210 is cylindrical and has a diameter that is approximately the same as the mounting posts 404. Although the board 128 is not shown in FIG. 4, the intermediate portion 402 and the mounting posts 404 extend through corresponding holes 502 (shown in FIG. 5) in the board 128. The mounting posts 404 are used to mount the ground shield structure 208 to the board 128, and the intermediate portion 402 is used to mount the signal conductor 210 to the board 128.

Figure 5:
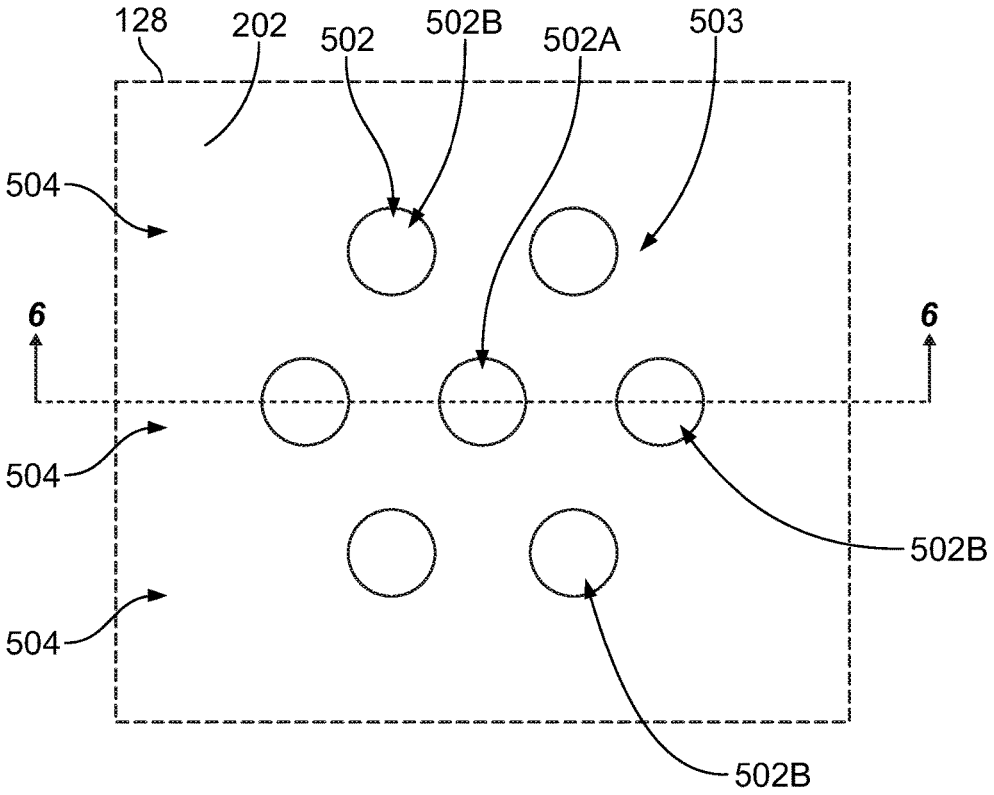
FIG. 5 shows a top view of a portion of a board of the electrical contact grid array according to an embodiment.

Additional reference is made to FIG. 5, which shows a top view of a portion of the board 128 according to an embodiment. The board 128 defines multiple holes 502 that extend into the board 128 from the top side 202. In one or more embodiments, the holes 502 extend fully through the board 128 such that the holes 502 are open along the top side 202 and the opposite bottom side 204 (shown in FIG. 3). In the illustrated embodiment, a central hole 502A is surrounded by outer holes 502B. The intermediate portion 402 of the signal conductor 210 is received in the central hole 502A. The mounting posts 404 of the ground shield structure 208 are received in the outer holes 502B. In the illustrated embodiment, there are six outer holes 502B, and the ground shield structure 208 has six mounting posts 404 that are each received in a different one of the outer holes 502B. In other embodiments, the board 128 may include fewer or greater than six outer holes 502B and/or the ground shield structure 208 may include fewer or greater than six mounting posts 404. For example, even if there are six outer holes 502B in the board 128 surrounding the central hole 502A, in one alternative embodiment the ground shield structure 208 has two, three, or four mounting posts 404, such that at least some of the outer holes 502B do not receive a mounting post 404. In the illustrated embodiment, the outer holes 502B are arranged around the central hole 502A to define a group or pod 503 of holes 502 for a shielded conductor set 126. Although not shown in FIG. 5, the board 128 includes multiple pods 503 of holes 502 in order for multiple shielded conductor sets 126 to mount to the board 128. Alternatively or in addition to discrete, spaced-apart pods 503 of holes 502, the holes 502 may be arranged in parallel rows 504. The rows 504 may have uniform spacing between adjacent holes 502. The signal conductor 210 and ground shield structure 208 of each shielded conductor set 126 may mount to holes 502 in multiple rows 504. For example, the six outer holes 502B may be located in three different parallel rows 504, although the rows 504 do not continue outside of the pod 503 in the illustrated embodiment.

The board 128 is made of an electrically insulative material. For example, the board 128 may be made of a polyimide. The board 128 may have a thickness of about 1-10 millimeters, such as about 5 millimeters. In another embodiment, the board 128 may be a different electrically insulative substrate, such as an epoxy resin, glass, or the like.

Figure 6:
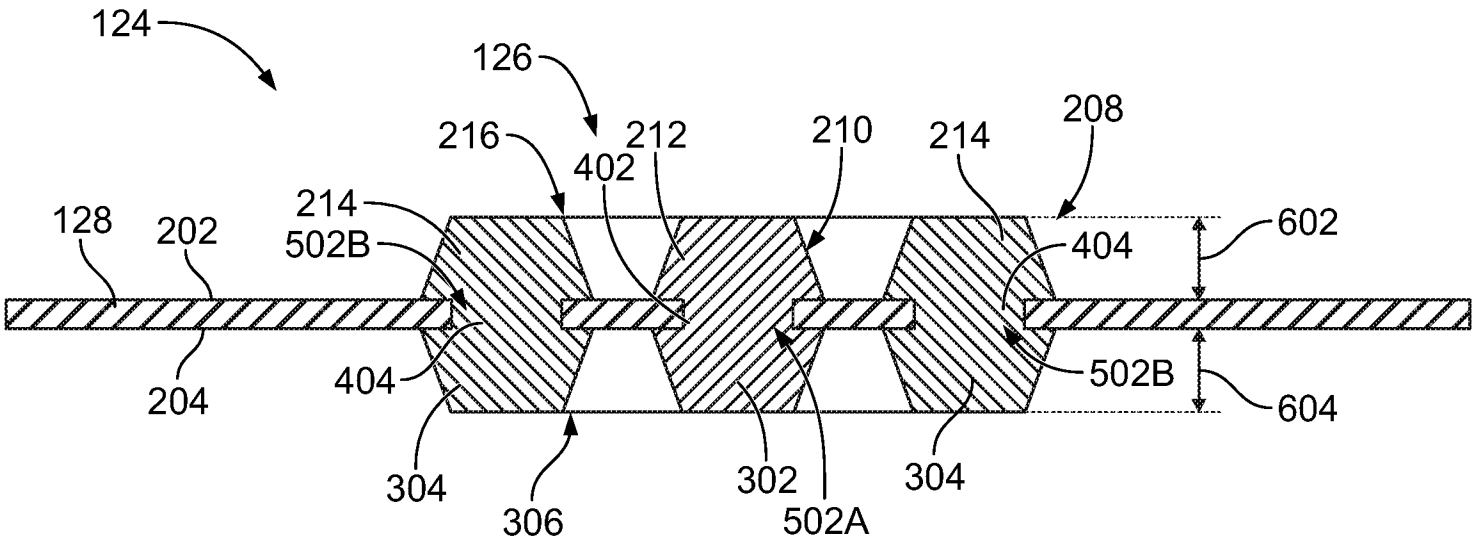
FIG. 6 is a side cross-sectional view of a portion of the electrical contact grid array showing one shielded conductor set mounted to the board according to an embodiment.

FIG. 6 is a side cross-sectional view of a portion of the electrical contact grid array 124 showing one shielded conductor set 126 mounted to the board 128 according to an embodiment. The cross-section is taken along line 6-6 shown in FIGS. 3 and 5. The signal conductor 210 extends through the central hole 502A such that the upper signal contact 212 extends above the top side 202 of the board 128, the lower signal contact 302 extends below the bottom side 204 of the board 128, and the intermediate portion 402 is disposed within the central hole 502A. The upper and lower signal contacts 212, 302 have larger sizes (e.g., diameters) than the central hole 502A, at least along portions of the signal contacts 212, 302 proximate to the board 128, which retains the signal conductor 210 on the board 128. The signal conductor 210 may be molded in-situ on the board 128. Alternatively, the signal conductor 210 may be at least partially compressible and is forced through the central hole 502A for mounting to the board 128. The smaller opening of the hole 502A causes the upper or lower signal contact 212, 302 to compress as the signal conductor 210 is forced through the hole 502A.

The upper ground contact 214 that defines the upper annular shield 216 is disposed above the top side 202, the lower ground contacts 304 that define the lower annular shield 306 are disposed below the bottom side 204, and the mounting posts 404 are located within corresponding outer holes 502B. In an embodiment, the ground shield structure 208 is molded in-situ on the board 128. As a result, the upper ground contact 214, the lower ground contacts 304, and the mounting posts 404 are integrally formed with one another. Since the upper and lower ground contacts 214, 304 have curved lengths that extend between the outer holes 502B along the top and bottom sides 202, 204 of the board 128, there is no risk of the ground shield structure 208 dismounting from the board 128.

As shown in FIG. 6, the height 602 of the upper ground contact 214 above the top side 202 of the board 128 is approximately equal to the height of the upper signal contact 212. Therefore, the upper annular shield 216 defined by the upper ground contact 214 circumferentially surrounds approximately the entire height of the upper signal contact 212. Furthermore, the height 604 of the lower ground contacts 304 below the bottom side 204 of the board 128 is approximately equal to the height of the lower signal contact 302, such that the lower annular shield 306 circumferentially surrounds approximately the entire height of the lower signal contact 302.

The signal conductor 210 and the ground shield structure 208 are both electrically conductive. Optionally, the signal conductor 210 may be of a conductive material that has a lower electrical resistivity than a conductive material that forms the ground shield structure 208. Therefore, the signal conductor 210 may have a greater electrical conductivity than the ground shield structure 208. In an embodiment, the ground shield structure 208 may be formed of a lower cost conductive material than the conductive material of the signal conductor 210 in order to reduce costs. For example, the ground shield structure 208 could include a metal, such as nickel, that is cheaper than a metal used in the signal conductor 210, such as silver.

The signal conductor 210 may be made of one or more metals (e.g., silver, copper, gold, or a metal alloy), one or more metals dispersed in a polymer material (e.g., a lossy material), a conductive polymer, or the like. In an embodiment in which the signal conductor 210 is compressible, the signal conductor 210 may be a lossy material or a conductive polymer. In another embodiment in which the signal conductor 210 is a deflectable beam or a pin, the signal conductor 210 may be a metal or metal alloy.

In the one or more embodiments in which the ground shield structure 208 is molded in-situ on the board 128, the ground shield structure 208 is a lossy material or a conductive polymer. For example, the lossy material or the conductive polymer material may be molded in-situ on the board 128 using a mold that is coupled to the board 128. The ground shield structure 208 made of the lossy material or the conductive polymer may be at least partially compressible. In an alternative embodiment, the ground shield structure 208 may be assembled onto the board 128, such as by coupling the upper ground contact 214 to the lower ground contacts 304 via the mounting posts 404. The ground shield structure 208 may be assembled on the board 128 using an adhesive, soldering, a fastener, or the like. In such an alternative embodiment, the ground shield structure 208 may be made of one or more metals (e.g., nickel, silver, copper, or a metal alloy), a lossy material, a conductive polymer, or the like.

As used herein, a conductive polymer refers to an organic polymer that conducts electricity. In general, conductive polymers include a carbon chain having alternating single and double bonds. The conductive polymers are typically doped to increase the conductivity by adding or removing electrons at the outer orbitals. Examples of conductive polymers include polyacetylene, polyaniline, polypyrrole, and the like. In an embodiment, the conductive polymer may be a silicon polymer that defines a matrix used to hold solid or plated metal particles comprised of, for example, silver, nickel, copper, and/or the like.

As used herein, a lossy material includes conductive particles dispersed within a dielectric or insulative material. The conductive particles may be filler elements (or fillers) and the dielectric material may be a binder that is used to hold the conductive particles in place. The conductive particles used as fillers may include metal, carbon and/or graphite formed as fibers, flakes, powder, or other particles. Combinations of fillers may be used in some embodiments, such as metal plated (or coated) particles. Silver and nickel may be used to plate particles. Plated (or coated) particles may be used alone or in combination with other fillers, such as carbon flakes. The filler particles may be present in a sufficient volume percentage to allow conducting paths to be created from particle to particle. The binder material may be a thermoplastic material (e.g., a liquid crystal polymer), an epoxy, a thermosetting resin, and/or an adhesive. The binder material is configured to facilitate the molding of the lossy material into the desired shape. Due to the dispersion of the conductive particles in the binder material, the lossy material is less conductive than the conductive material that forms the signal conductor 210.

Figure 7:
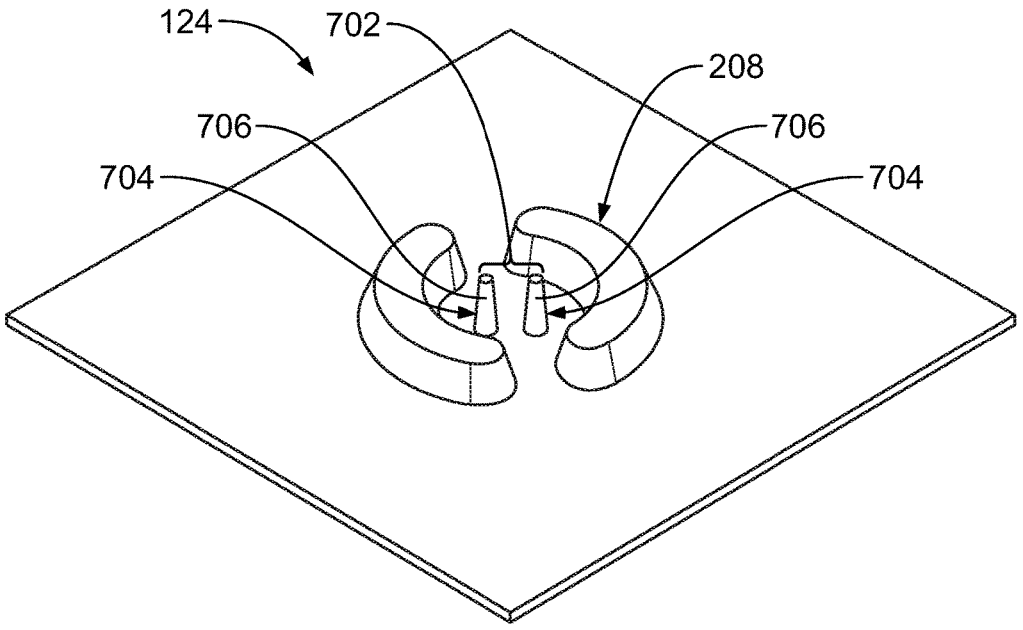
FIG. 7 is a perspective view of a portion of the electrical contact grid array according to an alternative embodiment.

FIG. 7 is a perspective view of a portion of the electrical contact grid array 124 according to an alternative embodiment. In the illustrated embodiment, each ground shield structure 208 circumferentially surrounds a pair 702 of signal conductors 704, instead of a single signal conductor 210 as shown in the embodiments of FIGS. 2-4 and 6. The signal conductors 704 may represent a differential pair 702 used to convey differential signals. The ground shield structure 208 electrically shields the pair 702 of signal conductors 704 from proximate pairs 702 in the array 124 and other electrical elements. In the illustrated embodiment, the signal conductors 704 have upper signal contacts 706 in the shape of pins, but the signal contacts 706 can have other shapes in other embodiments, such as deflectable beams, balls, or barrels (e.g., like the barrels 212, 302 shown in FIG. 4).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical contact grid array comprising:

a board having a top side and an opposite bottom side, the board defining holes that extend into the board from the top side;

a plurality of signal conductors mounted to the board, each of the signal conductors including an upper signal contact extending beyond the top side of the board for electrically connecting with a corresponding mating contact of a mating circuit board that is above the top side of the board; and a plurality of ground shield structures mounted to the board, each of the ground shield structures including at least one ground contact disposed above the top side of the board and at least one mounting post extending from the at least one ground contact into a corresponding one of the holes in the board, the at least one ground contact defining an upper annular shield that circumferentially surrounds at least one of the upper signal contacts.

2. The electrical contact grid array of claim 1, wherein the at least one ground contact of each of the ground shield structures has a curved length along a plane parallel to the top side of the board.

3. The electrical contact grid array of claim 1, wherein the upper annular shield of each of the ground shield structures is defined by a unitary, one-piece ground contact that forms a closed ring completely surrounding the at least one of the upper signal contacts.

4. The electrical contact grid array of claim 1, wherein the ground shield structures comprise one or more of a conductive polymer material or an electrically lossy material.

5. The electrical contact grid array of claim 1, wherein the signal conductors are comprised of a first conductive material and the ground shield structures are comprised of a second conductive material, the second conductive material of the ground shield structures having a greater electrical resistivity than the first conductive material of the signal conductors.

6. The electrical contact grid array of claim 1, wherein the upper signal contacts include one or more of contact beams, pins, balls, or barrels.

7. The electrical contact grid array of claim 1, wherein the holes extend fully through the board, the signal conductors further including lower signal contacts extending beyond the bottom side of the board, wherein each of the ground contacts disposed above the top side of the board is an upper ground contact, wherein each of the ground shield structures further includes at least one lower ground contact disposed below the bottom side of the board to define a lower annular shield that circumferentially surrounds at least one of the lower signal contacts.

8. The electrical contact grid array of claim 1, wherein the ground shield structures are molded in-situ on the board.

9. The electrical contact grid array of claim 1, wherein the ground shield structures are arranged in multiple parallel rows along the top side of the board.

10. An electrical contact grid array comprising:

a board having a top side and an opposite bottom side, the board defining holes extending through the board from the top side to the bottom side;

a plurality of signal conductors mounted to the board, each of the signal conductors including an upper signal contact extending beyond the top side of the board, a lower signal contact extending beyond the bottom side of the board, and an intermediate portion disposed within a corresponding one of the holes in the board; and a plurality of ground shield structures mounted to the board, each of the ground shield structures including an upper annular shield defined by at least one upper ground contact, a lower annular shield defined by at least one lower ground contact, and mounting posts extending through the holes in the board, the mounting posts connecting the upper ground contacts to the lower ground contacts, the upper annular shield of each of the ground shield structures circumferentially surrounding at least one of the upper signal contacts, the lower annular shield of each of the ground shield structures circumferentially surrounding at least one of the lower signal contacts.

11. The electrical contact grid array of claim 10, wherein the upper ground contacts have curved lengths along a plane parallel to the top side of the board, and the lower ground contacts have curved lengths along a plane parallel to the bottom side of the board.

12. The electrical contact grid array of claim 10, wherein at least one of the upper annular shield or the lower annular shield of each of the ground shield structures is defined by a unitary, one-piece ground contact that forms a closed ring.

13. The electrical contact grid array of claim 10, wherein the at least one upper ground contact of each of the ground shield structures is spaced apart along the top side of the board from the at least one upper signal contact that is circumferentially surrounded by the respective ground shield structure, and the at least one lower ground contact of each of the ground shield structures is spaced apart along the bottom side of the board from the at least one lower signal contact that is circumferentially surrounded by the respective ground shield structure.

14. The electrical contact grid array of claim 10, wherein the ground shield structures are molded in-situ on the board such that the at least one upper ground contact, the at least one lower ground contact, and the mounting posts of a common ground shield structure are integrally formed with one another.

15. The electrical contact grid array of claim 10, wherein the ground shield structures are comprised of one or more of a conductive polymer material or an electrically lossy material.

16. An electrical contact grid array comprising:

a board having a top side and an opposite bottom side;

a plurality of signal conductors mounted to the board, each of the signal conductors including an upper signal contact extending beyond the top side of the board for electrically connecting with a corresponding mating contact of a mating circuit board that is above the top side of the board; and a plurality of ground shield structures mounted to the board, each of the ground shield structures including at least one ground contact disposed above the top side of the board and defining an upper annular shield, the upper annular shield circumferentially surrounding at least one of the upper signal contacts, the ground shield structures comprised of one or more of a conductive polymer material or an electrically lossy material.

17. The electrical contact grid array of claim 16, wherein the ground contacts have curved lengths along a plane parallel to the top side of the board.

18. The electrical contact grid array of claim 16, wherein the board is electrically insulative.

19. The electrical contact grid array of claim 16, wherein the board defines holes that extend into the board from the top side, and the ground shield structures include at least one mounting post extending from the at least one ground contact into the holes in the board to mount the ground shield structures to the board.

20. The electrical contact grid array of claim 19, wherein the holes extend fully through the board, wherein the ground contacts disposed above the top side of the board are upper ground contacts and each of the ground shield structures also includes at least one lower ground contact disposed below the bottom side of the board and connected to the at least one upper ground contact via the at least one mounting post, the at least one lower ground contact defining a lower annular shield that circumferentially surrounds at least one lower signal contact of the signal conductors.

* * * * *